US008480441B2

(12) United States Patent
Wu et al.

(10) Patent No.: US 8,480,441 B2
(45) Date of Patent: Jul. 9, 2013

(54) CONNECTION MEMBER AND LEAD TERMINAL SEAT STRUCTURE WITH THE CONNECTION MEMBER

(75) Inventors: Chih-Yuan Wu, New Taipei (TW); Meng-Yew Tasi, New Taipei (TW)

(73) Assignee: Switchlab (Shanghai) Co., Ltd., Shanghai (CN)

( * ) Notice: Subject to any disclaimer, the term of this patent is extended or adjusted under 35 U.S.C. 154(b) by 8 days.

(21) Appl. No.: 13/231,099

(22) Filed: Sep. 13, 2011

(65) Prior Publication Data

US 2012/0064780 A1 Mar. 15, 2012

(30) Foreign Application Priority Data

Sep. 15, 2010 (CN) ..... 2010 1 0282056

(51) Int. Cl.
*H01R 9/22* (2006.01)

(52) U.S. Cl.
USPC ..... 439/716; 439/491

(58) Field of Classification Search
USPC ..... 439/716, 717, 491
See application file for complete search history.

(56) References Cited

U.S. PATENT DOCUMENTS

| | | | | | |
|---|---|---|---|---|---|
| 4,171,861 | A * | 10/1979 | Hohorst | ..... | 439/94 |
| 4,478,477 | A * | 10/1984 | Fleisher | ..... | 439/713 |
| 5,080,607 | A * | 1/1992 | Cristescu | ..... | 439/491 |
| 5,419,715 | A * | 5/1995 | Laveissiere | ..... | 439/491 |
| 2012/0064780 | A1 * | 3/2012 | Wu et al. | ..... | 439/712 |

* cited by examiner

*Primary Examiner* — James Harvey
(74) *Attorney, Agent, or Firm* — Rosenberg, Klein & Lee

(57) ABSTRACT

A connection member and a lead terminal seat structure with the connection member including a terminal seat and a connection member. The connection member has a first edge and a second edge, which are formed with alternately arranged depression sections and protrusion sections. The terminal seat has a recess formed with ridge sections and through sections in adjacency to the ridge sections. The ridge sections and the through sections are arranged corresponding to the depression sections and protrusion sections of the connection member with the connection member received in the recess of the terminal seat with the depression sections and the protrusion sections insert-connected with the ridge sections and the through sections.

30 Claims, 4 Drawing Sheets

CONNECTION MEMBER AND LEAD TERMINAL SEAT STRUCTURE WITH THE CONNECTION MEMBER

BACKGROUND OF THE INVENTION

1. Field of the Invention

The present invention relates generally to a connection member and a lead terminal seat structure with the connection member.

2. Description of the Related Art

A conventional lead terminal or solderless terminal has an insulation housing (generally made of plastic material) and leaf spring or metal piece enclosed in the insulation housing for pressing and electrically connecting with a lead inserted in the lead terminal. For example, U.S. Pat. No. 6,689,955 B2 entitled "connecting device with a connection spring operated by a cam" discloses a typical lead terminal.

Such lead terminal is inserted on a circuit board (such as a PC circuit board). The insulation housing of the lead terminal has multiple perforations. The leads extending from a machine or equipment can be inserted through the perforations into the housing. The housing defines a cavity in which the leaf spring or metal piece is mounted. The lead can be inserted into the cavity into electrical contact with the leaf spring or metal piece. The leaf spring or metal piece has a head end. After the lead is inserted into the housing, the head end holds the lead to prevent the lead from disconnecting from the leaf spring or metal piece or detaching from the insulation housing. A user needs to extend a tool such as a screwdriver into the housing to push the head end for releasing and disconnecting the lead from the leaf spring or metal piece. The metal piece has a pair of fine symmetrical pins for complementarily insert-connecting with the pins of the circuit board or the pins of another lead terminal.

It is troublesome for an operator to use the tool to release and disconnect the lead from the leaf spring or metal piece and detach the lead from the insulation housing. Therefore, in the above patent, a cam is disposed in the insulation housing in abutment with the leaf spring or metal piece. The cam has a lever section extending out of the housing. An operator can forcedly shift the lever to make the cam press the metal piece into contact with the lead or release the metal piece to free the lead.

The existent terminal seat includes a front casing and a rear casing made with molds. (The direction in which the lead enters the terminal seat is defined as front face and the casing with the perforation is defined as front casing). The front and rear casings are assembled to form a terminal seat product. To meet the actual requirement in a working site, it often takes place that different specifications of terminal seats with different numbers of perforations, (for example, two-perforation and five-perforation terminal seats) are needed. Accordingly, a manufacturer must manufacture different specifications of mold sets for manufacturing different sizes of front and rear casings with different numbers of perforations. As a result, the mold cost is quite high and a larger operation room is required.

In practice, the terminal seat or the front casing is marked with serial numbers such as A1, B2, C3, D4 in an encoding/printing process according to the number and sequence of the perforations of each terminal seat for a user to distinguish between the positions of the leads and know the connection relationship between the leads and the perforations of the terminal seat after the terminal seat and the leads are mounted. As known by those who skilled in this field, the manufacturer must prepare different sizes of stamping molds according to different specifications of terminal seat structures for receiving and fixing the terminal seats and performing the encoding/printing process. Accordingly, the stamping molds will have considerably larger volume.

As aforesaid, the conventional terminal seat has many shortcomings that need to be overcome. It is therefore tried by the applicant to provide an improved lead terminal seat structure, which has better stability and binding ability. Moreover, the mold cost and manufacturing cost for the lead terminal seat structure are lowered and the operation room for the lead terminal seat structure is minimized. The improved lead terminal seat structure has the following characteristics:

1. The improved lead terminal seat structure includes a terminal seat composed of a first insulation casing (left casing) and at least one second insulation casing (right casing) and a subsidiary sidewall. According to different specifications and conditions, one or more second casings can be assembled with the first casing and the subsidiary sidewall to form terminal seats with different specifications and different numbers of perforations for different applications. In contrast, in the conventional technique, it is necessary for a manufacturer to manufacture different specifications of mold sets for making different specifications of terminal seats with different numbers of perforations. This necessitates larger operation room and leads to increase of the manufacturing cost. The improved lead terminal seat structure overcomes the above problem existing in the prior art.
2. The improved lead terminal seat structure further includes a connection member for connecting the first and second casings (left and right casings) and the subsidiary sidewall. The connection member provides higher binding force and connection force for the first and second casings and the subsidiary sidewall. Accordingly, the first and second casings and the subsidiary sidewall of the terminal seat are more securely assembled with each other to bear the action force or external force applied to the cam operation lever for shifting the cam operation lever. Therefore, the terminal seat is protected from breaking apart or loosening and the leads can be more stably electrically connected with the terminal seat without swinging, poor contact or detachment.
3. The connection member provides higher binding force and connection force in the direction of the transverse reference axis for the first and second casings and the subsidiary sidewall. Accordingly, the first and second casings and the subsidiary sidewall of the terminal seat are more securely assembled with each other to bear the action force or external force applied to the operation lever and avoid lateral breakage or loosening due to the action force or external force.
4. The connection member has a lightweight and simple structure. Different sizes or lengths of connection members can be conveniently adaptively manufactured according to the specifications or the numbers of perforations of the terminal seats. The manufacturer can use a simple stamping mold to encode the connection member. In contrast, in the conventional technique, the manufacturer needs to prepare different sizes of stamping molds for different specifications of terminal seats. Such stamping molds have larger volume. The improved lead terminal seat structure overcomes this problem existing in the conventional technique.

SUMMARY OF THE INVENTION

It is therefore a primary object of the present invention to provide a connection member and a lead terminal seat structure with the connection member. The lead terminal seat structure includes a terminal seat and a connection member. The terminal seat is manufactured at lower cost and is integrally assembled by the connection member to avoid loosening or breakage.

To achieve the above and other objects, the lead terminal seat structure with the connection member of the present invention includes a terminal seat and a connection member. The connection member has a first edge and a second edge. The first and second edges of the connection member are formed with depression sections and protrusion sections, which are alternately arranged. The terminal seat has a recess. The recess is formed with ridge sections and through sections in adjacency to the ridge sections. The ridge sections and the through sections are arranged corresponding to the depression sections and protrusion sections of the connection member, whereby the connection member is received in the recess of the terminal seat with the depression sections and the protrusion sections insert-connected with the ridge sections and the through sections so as to integrally combine the connection member with the terminal seat.

The connection member of the present invention has a lightweight and simple structure so as to simplify the encoding process.

The connection member has a first edge and a second edge. The first and second edges of the connection member are formed with depression sections and protrusion sections, which are alternately arranged.

In comparison with the conventional terminal seat, the connection member and the lead terminal seat structure with the connection member of the present invention have the following advantages:

1. Different specifications of terminal seats with different numbers of perforations can be formed to a user to apply. Therefore, the manufacturing cost for the terminal seat is lowered and the operation room is minified.
2. The connection member provides higher binding force and connection force for the first and second casings and the subsidiary sidewall. Accordingly, the first and second casings and the subsidiary sidewall of the terminal seat are more securely and integrally assembled with each other to bear the action force applied to the operation lever for shifting the operation lever. Therefore, the terminal seat is protected from loosening or breaking apart at the assembled sections.
3. The connection member has a lightweight and simple structure and can be easily manufactured.
4. It is unnecessary for a manufacturer to prepare different sizes of stamping molds for different specifications of terminal seats. The manufacturer only needs to use a simple stamping mold to perform the encoding process.

The present invention can be best understood through the following description and accompanying drawings, wherein:

DETAILED DESCRIPTION OF THE PREFERRED EMBODIMENTS

Figure 1:
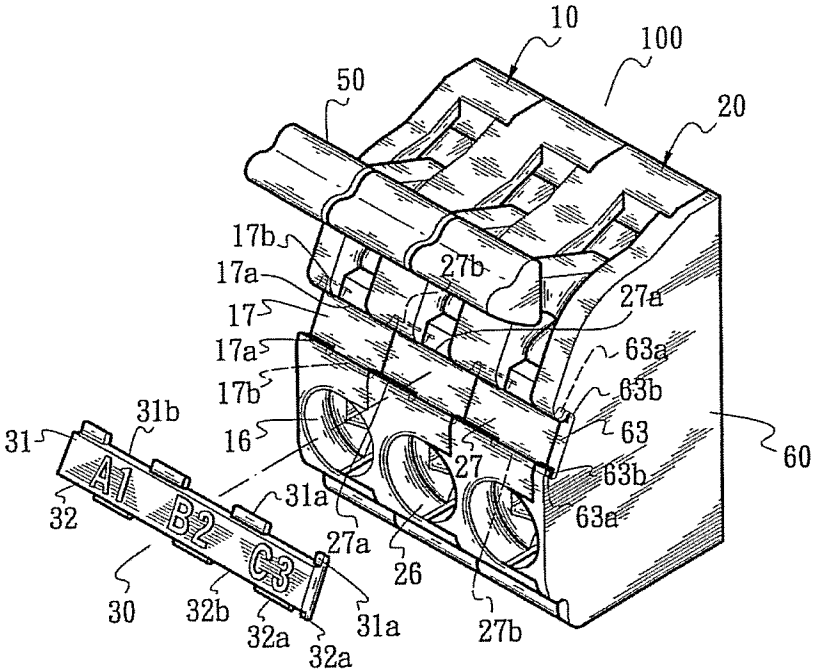
FIG. 1 is a perspective view showing the lead terminal seat structure with the connection member of the present invention, in which the terminal seat has three perforations.
Figure 2:
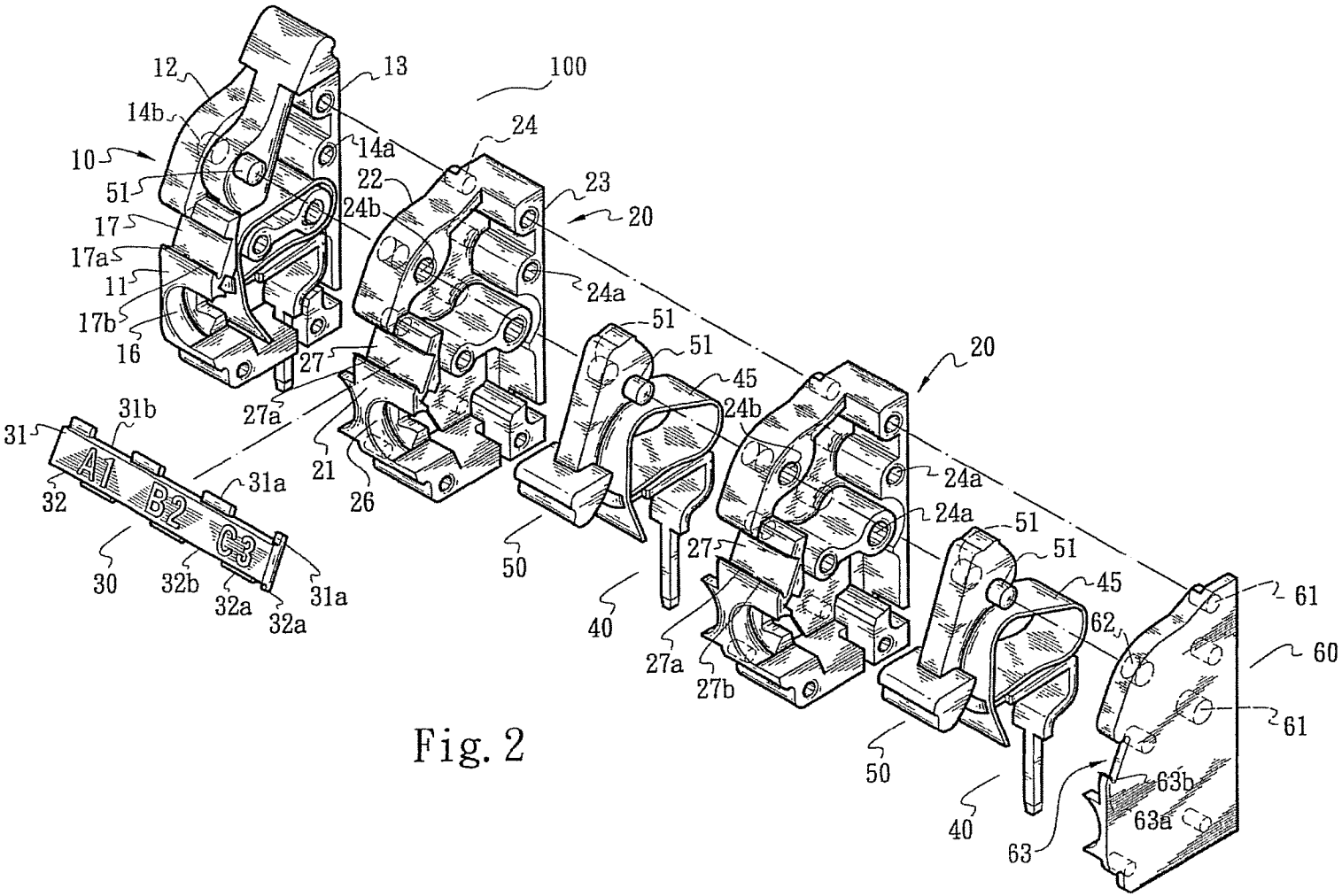
FIG. 2 is a perspective exploded view of the lead terminal seat structure with the connection member of the present invention, showing the relative positions between the first and second casings, the connection member, the metal pieces and the operation levers.

Please refer to FIGS. 1 and 2. The present invention relates to a connection member and a lead terminal seat structure with the connection member. The lead terminal seat structure of the present invention includes a terminal seat 100, a connection member 30, metal pieces 40 and operation levers 50. FIG. 2 shows the relative positions between these components. Each metal piece 40 includes a leaf spring 45. Basically, the arrangement of the metal pieces 40, the leaf springs 45 and the operation levers 50 pertains to prior art and thus will not be further described hereinafter.

In a preferred embodiment, the terminal seat 100 is made of plastic material in the form of an insulation housing. The terminal seat 100 includes a first casing 10 (defined as left casing), a second casing 20 (defined as right casing) and a subsidiary sidewall 60. It should be noted that the subsidiary sidewall 60 can be alternatively directly assembled with the first casing 10. Each of the casings 10, 20 has a front face 11, 21, a sidewall 12, 22 and a rear wall 13, 23. (The direction or position where the lead enters the terminal seat is defined as the front face). The first and second casings 10, 20 define a cavity. As shown in the drawings, the second casing 20 is positioned between the first casing 10 and the subsidiary sidewall 60.

Referring to FIG. 2, the first casing 10 is formed with multiple mortises 14*a*. The sidewall 22 of the second casing 20 is formed with multiple tenons 24 corresponding to the mortises 14*a*. The tenons 24 are inserted into the mortises 14*a* to assemble the first and second casings 10, 20 with each other. The leaf spring 45, the metal piece 40 and the operation lever 50 are mounted in the cavity. In a preferred embodiment, the other face of the second casing 20 opposite to the sidewall 22 is formed with mortises 24*a* for assembling with the subsidiary sidewall 60. To speak more specifically, the subsidiary sidewall 60 is formed with multiple tenons 61 corresponding to the mortises 24*a* of the second casing 20. The tenons 61 are inserted into the mortises 24*a* to assemble the subsidiary sidewall 60 with the second casing 20. The subsidiary sidewall 60 and the second casing 20 together define a cavity in which the leaf spring 45, the metal piece 40 and the operation lever 50 are mounted.

In a modified embodiment, the first casing 10 is alternatively formed with tenons and the sidewall 22 of the second casing 20 is alternatively formed with mortises corresponding to the tenons. It should be noted that such modification is also applicable to the second casing 20 and the subsidiary sidewall 60.

Figure 5:
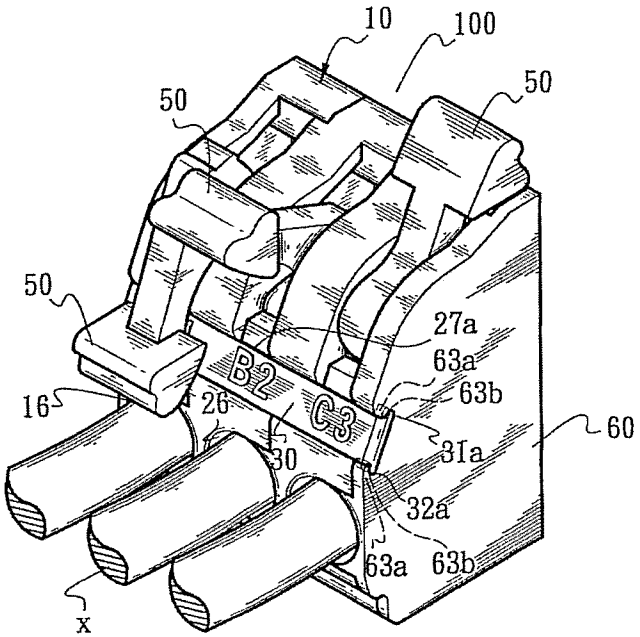
FIG. 5 is a perspective assembled view of the lead terminal seat structure with the connection member of the present invention, showing that the leads are inserted into the terminal seat and the operation levers are shifted to lock the leads with the terminal seat.

The front face 11, 21 of each of the casings 10, 20 is formed with a perforation 16, 26. A lead x can be inserted through the perforation 16, 26 into the casing 10, 20 into electrical contact with the metal piece 40 (as shown in FIG. 5). A three-perforation terminal seat 100 is taken as an example and shown in the drawings for illustration. FIG. 2 also shows that the operation lever 50 has stubs 51, which are respectively inserted in a dent 14*b* of the first casing 10 and a dent 24*b* of the second casing 20 or the dent 24*b* of the second casing 20 and a dent 62 of the subsidiary sidewall 60. Accordingly, the operation lever 50 can be reciprocally moved about the stubs 51 and the dents 14*b*, 24*b* or 62 between an upper dead end and a lower dead end as shown in the drawings.

In a preferred embodiment, the front face of the terminal seat 100 or the front faces 11, 21 of the first and second casings 10, 20 have recesses 17, 27. The recesses 17, 27 are formed with ridge sections 17*a*, 27*a* and through sections 17*b*, 27*b* in adjacency to the ridge sections 17*a*, 27*a*. FIG. 2 shows that the ridge sections 17*a*, 27*a* and the through sections 17*b*, 27*b* are formed on the upper and lower sides of the recesses 17, 27. It should be noted that the subsidiary sidewall 60 is also formed with a recess 63. The recess 63 also has a ridge section 63*a* and a through section 63*b*. In a modified embodiment, the recesses 17, 27 (or 63) can be alternatively formed on the rear walls 13, 23 of the first and second casings 10, 20 (or the subsidiary sidewall 60).

Figure 3:
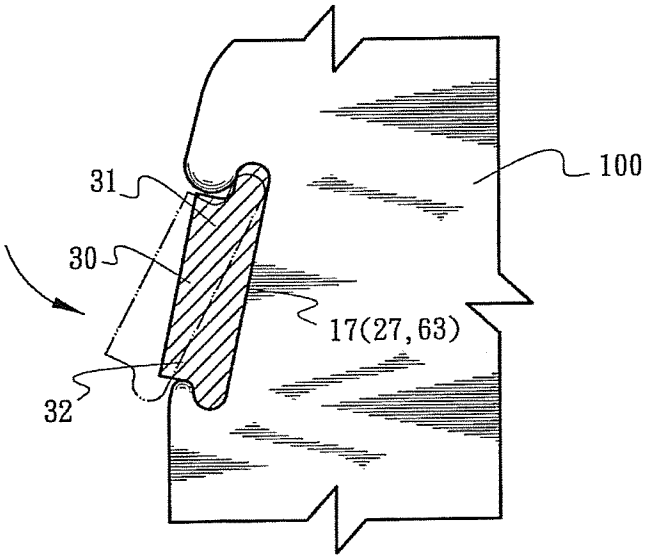
FIG. 3 is a side sectional schematic diagram of the lead terminal seat structure with the connection member of the present invention, showing that the connection member is assembled with the terminal seat.

Referring to FIGS. 2 and 3, the connection member 30 is positioned in the recesses 17, 27, 63. In this embodiment, the connection member 30 is made of plastic material, POM and fiber material, NY and fiber material, PEI, PPS or the like in the form of a plate member. The connection member 30 has a first edge 31 and a second edge 32. The first and second edges 31, 32 of the connection member 30 are formed with protrusion sections 31*a*, 32*a* and depression sections 31*b*, 32*b*, which are alternately arranged corresponding to the ridge sections 17*a*, 27*a*, 63*a* and the trough sections 17*b*, 27*b*, 63*b*. In a preferred embodiment, the depression sections and protrusion sections 31*b*, 31*a* of the first edge 31 of the connection member are arranged in a pattern complementary to the pattern in which the protrusion sections and depression sections 32*a*, 32*b* of the second edge 32 of the connection member are arranged. To speak more specifically, the depression sections 31*b* of the first edge 31 are aligned with the protrusion sections 32*a* of the second edge 32, while the protrusion sections 31*a* of the first edge 31 are aligned with the depression sections 32*b* of the second edge 32.

Figure 4:
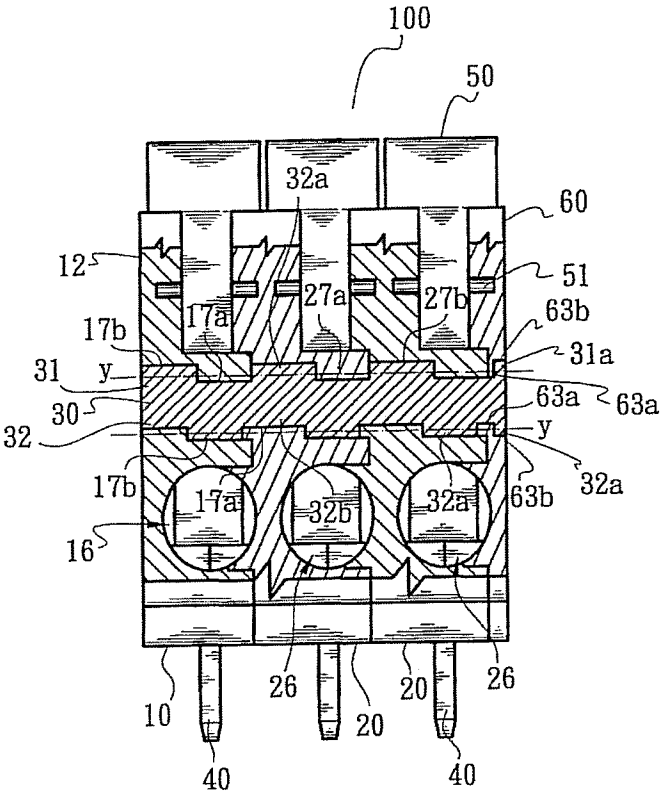
FIG. 4 is a sectional assembled view of the lead terminal seat structure with the connection member of the present invention, showing that the ridge sections and the through sections of the recess of the terminal seat are insert-connected with the depression sections and the protrusion sections of the connection member.

Please refer to FIGS. 3 and 4. After the connection member 30 is pressed into the recesses 17, 27, 63 of the terminal seat 100 or the first and second casings 10, 20 and the subsidiary sidewall 60, the connection member 30 is received in the recesses. Under such circumstance, the ridge sections 17*a*, 27*a*, 63*a* and the through sections 17*b*, 27*b*, 63*b* of the recesses 17, 27, 63 are respectively insert-connected with the depression sections 31*b*, 32*b* and the protrusion sections 31*a*, 32*a* of the connection member 30 in the same transverse reference axis y to together provide a binding force. Accordingly, the first and second casings 10, 20 and the subsidiary sidewall 60 are integrally combined with each other without loosing. In other words, the ridge sections 17*a*, 27*a*, 63*a* of the first and second casings 10, 20 and the subsidiary sidewall 60 are engaged with the protrusion sections 31*a*, 32*a* of the connection member 30 and lined up in the same axis without possibility of moving leftward or rightward according to the drawings.

Therefore, when a user shifts the operation lever 50 to control the leaf spring 45 or the metal piece 40 to hold or release the lead x (as shown by the phantom line of FIG. 5), the terminal seat 100 or the first and second casings 10, 20 and the subsidiary sidewall 60 can totally bear the action force or external force applied to the operation lever 50 without laterally loosening or breaking apart (in the direction of the transverse reference axis y).

In a preferred embodiment, after the connection member 30 is pressed into the recesses 17, 27, 63, the connection member 30 is affixed to the recesses 17, 27, 63 of the terminal seat 100 by means of ultrasonic welding or high frequency welding.

Figure 6:
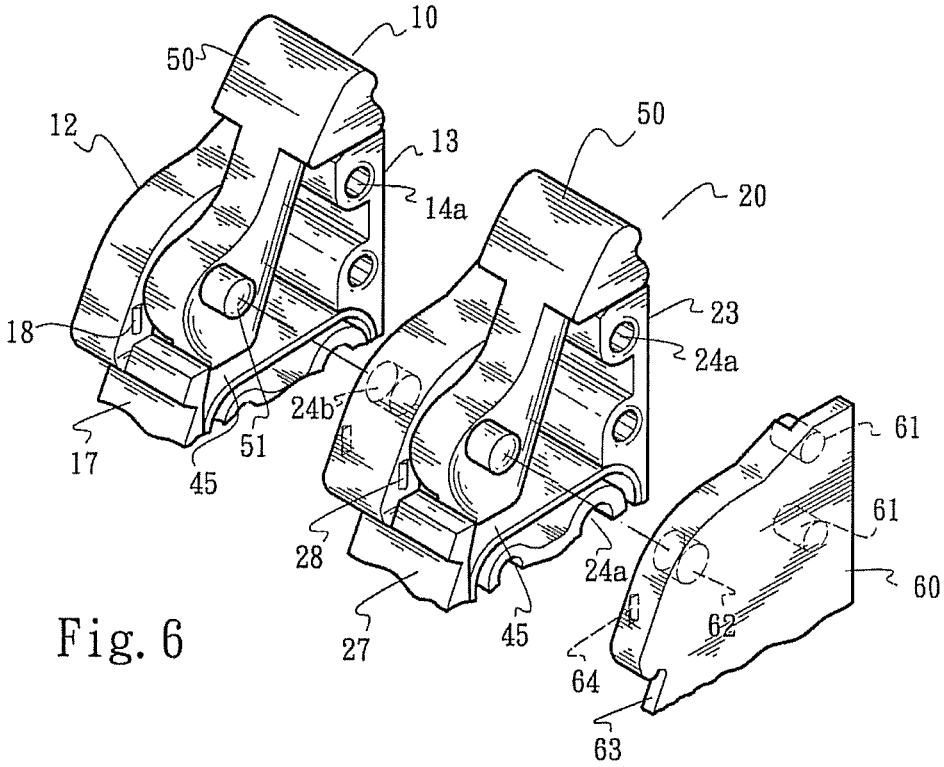
FIG. 6 is a perspective exploded view of the lead terminal seat structure with the connection member of the present invention, showing that a key structure with a triangular cross section is disposed on each of the first and second casings and the subsidiary sidewall.
Figure 7:
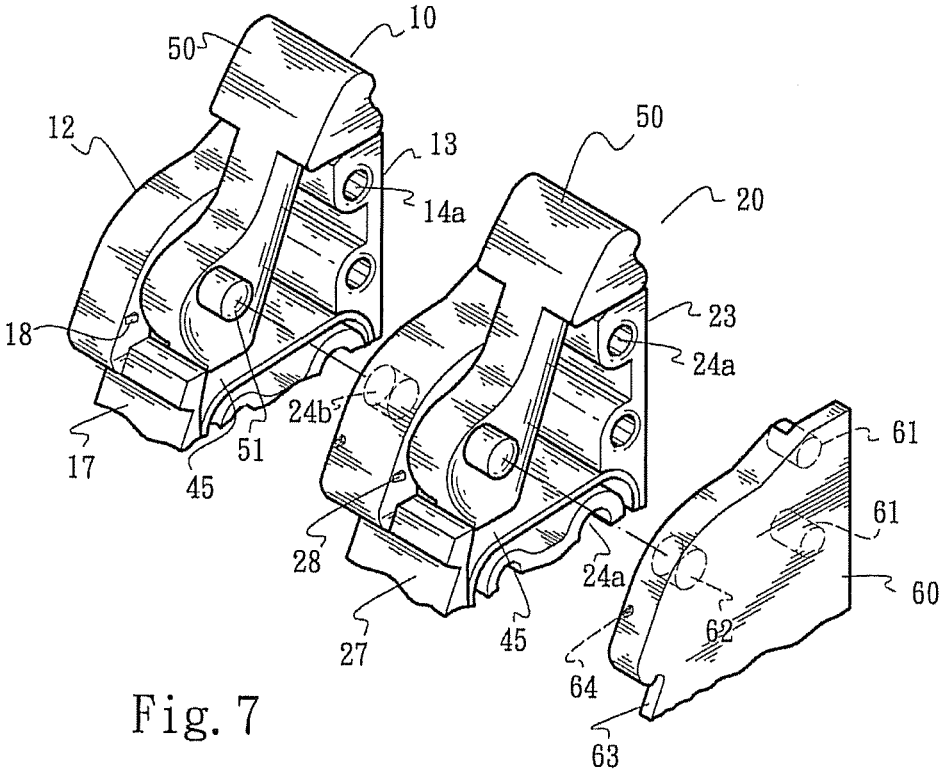
FIG. 7 is a perspective exploded view of the lead terminal seat structure with the connection member of the present invention, showing that a key structure with a substantially trapezoidal configuration or in the form of a V-shaped block is disposed on each of the first and second casings and the subsidiary sidewall.

Please refer to FIGS. 6 and 7. In another preferred embodiment, at least one toe section 18, 28, 64 is disposed on each of the first and second casings 10, 20 and the subsidiary sidewall 60 to provide a restriction or locating effect. When the operation lever 50 is shifted downward to the lower dead end, the toe section 18, 28, 64 interferences with the operation lever 50 to locate the operation lever 50. Unless a user forcedly shifts the operation lever 50 upward to overcome the interference of the toe section 18, 28, 64, the operation lever 50 is located at the lower dead end.

FIGS. 6 and 7 show that the toe section 18, 28, 64 has the form of a key. In FIG. 6, the toe section 18, 28, 64 is a key structure with a triangular cross section. In FIG. 7, the toe section 18, 28, 64 is a key structure with a substantially trapezoidal configuration or in the form of a V-shaped block. Alternatively, the toe section 18, 28, 64 can be substantially a flange structure.

According to the above arrangement, the lead terminal seat structure with the connection member of the present invention has the following advantages:

1. The lead terminal seat structure of the present invention includes a terminal seat 100 composed of a first insulation casing 10 (left casing), at least one second insulation casing 20 (right casing) and a subsidiary sidewall 60. According to different specifications and conditions, one or more second casings 20 can be assembled with the first casing 10 and the subsidiary sidewall 60 to form terminal seats with different specifications and different numbers of perforations 16, 26 for different applications. In contrast, in the conventional technique, it is necessary to manufacture different mold sets for making different specifications of terminal seats with different numbers of perforations. This necessitates larger operation room and leads to increase of the manufacturing cost.
2. The lead terminal seat structure of the present invention further includes a connection member 30 for connecting the first and second casings 10, 20 (left and right casings) and the subsidiary sidewall 60. The connection member 30 provides higher binding force and connection force in the direction of the transverse reference axis y for the first and second casings 10, 20 and the subsidiary sidewall 60. Accordingly, the first and second casings 10, 20 and the subsidiary sidewall 60 of the terminal seat 100 are more securely assembled with each other to bear the action force or external force applied to the operation lever 50 for shifting the operation lever 50. Therefore, the terminal seat 100 is protected from breaking apart or loosening at the assembled sections.

3. The connection member 30 has a lightweight and simple structure. Different sizes or lengths of connection members 30 can be conveniently adaptively manufactured according to the specifications or the numbers of perforations 16, 26 of the terminal seats 100.

4. The manufacturer can use a simple stamping mold to encode the connection member 30. For example, as shown in the drawings, the connection member 30 is stamped with numerals A1, B2, C3 in sequence. In contrast, in the conventional technique, the manufacturer needs to prepare different sizes of stamping molds for different specifications of terminal seats. Such stamping molds have larger volume.

In conclusion, the lead terminal seat structure with the connection member of the present invention has a novel configuration and is advantageous over the conventional terminal seat.

The above embodiments are only used to illustrate the present invention, not intended to limit the scope thereof. Many modifications of the above embodiments can be made without departing from the spirit of the present invention.

What is claimed is:

1. A lead terminal seat structure with a connection member, comprising a terminal seat and a connection member, the connection member having a first edge and a second edge, the first and second edges of the connection member being formed with depression sections and protrusion sections, which are alternately arranged, the terminal seat having a recess, the recess being formed with ridge sections and through sections in adjacency to the ridge sections, the ridge sections and the through sections being arranged corresponding to the depression sections and protrusion sections of the connection member, whereby the connection member is received in the recess of the terminal seat with the depression sections and the protrusion sections insert-connected with the ridge sections and the through sections so as to integrally combine the connection member with the terminal seat.

2. The lead terminal seat structure with the connection member as claimed in claim 1, wherein the protrusion sections and depression sections of the second edge of the connection member are arranged in a pattern complementary to a pattern in which the depression sections and protrusion sections of the first edge of the connection member are arranged.

3. The lead terminal seat structure with the connection member as claimed in claim 1, wherein the terminal seat at least includes a first casing having a front face, a sidewall and a rear wall to define a cavity, and a subsidiary sidewall disposed on the first casing.

4. The lead terminal seat structure with the connection member as claimed in claim 3, wherein the first casing is formed with multiple mortises and the subsidiary sidewall is formed with multiple tenons corresponding to the mortises, whereby the tenons are inserted in the mortises to insert-connect the subsidiary sidewall with the first casing.

5. The lead terminal seat structure with the connection member as claimed in claim 1, wherein the terminal seat includes a first casing having a front face, a sidewall and a rear wall to define a cavity, at least one second casing having a front face, a sidewall and a rear wall to define a cavity, and a subsidiary sidewall disposed on the second casing.

6. The lead terminal seat structure with the connection member as claimed in claim 5, wherein the first casing is formed with multiple mortises (14*a*) and the sidewall of the second casing is formed with multiple tenons corresponding to the mortises (14*a*), whereby the tenons are inserted in the mortises (14*a*) to assemble the first and second casings with each other, the other face of the second casing opposite to the sidewall being formed with mortises (24*a*), the subsidiary sidewall being formed with multiple tenons corresponding to the mortises (24*a*) of the second casing, the tenons being inserted into the mortises (24*a*) to assemble the subsidiary sidewall with the second casing.

7. The lead terminal seat structure with the connection member as claimed in claim 3, wherein the first casing is formed with a dent and the subsidiary sidewall is also formed with a dent, an operation lever having stubs corresponding to the dents, the stubs of the operation lever being respectively inserted into the dent of the first casing and the dent of the subsidiary sidewall, whereby the operation lever can be reciprocally moved about the stubs and the dents between a first dead end and a second dead end.

8. The lead terminal seat structure with the connection member as claimed in claim 5, wherein the first and second casings and the subsidiary sidewall are formed with dents, an operation lever having stubs corresponding to the dents, the stubs of the operation lever being respectively inserted into the dents, whereby the operation lever can be reciprocally moved about the stubs and the dents between a first dead end and a second dead end.

9. The lead terminal seat structure with the connection member as claimed in claim 3, wherein the recess is formed on at least one of the front face of the first casing, the rear wall of the first casing and the subsidiary sidewall.

10. The lead terminal seat structure with the connection member as claimed in claim 5, wherein the recess is formed on at least one of the front faces of the first and the second casings, the rear walls of the first and second casings and the subsidiary sidewall.

11. The lead terminal seat structure with the connection member as claimed in claim 10, wherein the recess is formed with ridge sections and through sections in adjacency to the ridge sections.

12. The lead terminal seat structure with the connection member as claimed in claim 1, wherein the depression sections and protrusion sections of the connection member correspond to the ridge sections and through sections of the recess respectively, whereby the depression sections and protrusion sections of the connection member are respectively insert-connected with the ridge sections and through sections of the recess in the same transverse reference axis.

13. The lead terminal seat structure with the connection member as claimed in claim 3, wherein at least one toe section is disposed on each of the first casing and the subsidiary sidewall.

14. The lead terminal seat structure with the connection member as claimed in claim 5, wherein at least one toe section is disposed on each of the first and second casings and the subsidiary sidewall.

15. The lead terminal seat structure with the connection member as claimed in claim 13, wherein the toe section has the form of a key with a geometrical cross section.

16. The lead terminal seat structure with the connection member as claimed in claim 14, wherein the toe section has the form of a key with a geometrical cross section.

17. The lead terminal seat structure with the connection member as claimed in claim 13, wherein the toe section is a flange structure.

18. The lead terminal seat structure with the connection member as claimed in claim 14, wherein the toe section is a flange structure.

19. The lead terminal seat structure with the connection member as claimed in claim 3, wherein the front face of the first casing is formed with a perforation.

20. The lead terminal seat structure with the connection member as claimed in claim 5, wherein the front face of each of the first and second casings is formed with a perforation.

21. The lead terminal seat structure with the connection member as claimed in claim 1, wherein the connection member is disposed in the recess and affixed to the recess by means of ultrasonic welding.

22. A connection member comprising a first edge and a second edge, the first edge of the connection member being formed with depression sections and protrusion sections, which are alternately arranged wherein the connection member is disposed on a terminal seat, the terminal seat having a recess, the recess being formed with ridge sections and through sections in adjacency to the ridge sections, the connection member being received in the recess of the terminal seat with the depression sections and the protrusion sections insert-connected with the ridge sections and the through sections so as to integrally combine the connection member with the terminal seat.

23. The connection member as claimed in claim 22, wherein the second edge of the connection member is formed with protrusion sections and depression sections, which are alternately arranged corresponding to the depression sections and protrusion sections of the first edge.

24. The connection member as claimed in claim 22, wherein the depression sections and protrusion sections of the connection member correspond to the ridge sections and through sections of the recess respectively, whereby the depression sections and protrusion sections of the connection member are respectively insert-connected with the ridge sections and through sections of the recess in the same transverse reference axis.

25. The connection member as claimed in claim 22, wherein the terminal seat at least includes a first casing having a front face, a sidewall and a rear wall to define a cavity, and a subsidiary sidewall disposed on the first casing.

26. The connection member as claimed in claim 25, wherein the first casing is formed with multiple mortises and the subsidiary sidewall is formed with multiple tenons corresponding to the mortises, whereby the tenons are inserted in the mortises to insert-connect the subsidiary sidewall with the first casing.

27. The connection member as claimed in claim 22, wherein the terminal seat includes a first casing having a front face, a sidewall and a rear wall to define a cavity, at least one second casing having a front face, a sidewall and a rear wall to define a cavity, and a subsidiary sidewall disposed on the second casing.

28. The connection member as claimed in claim 25, wherein the first casing is formed with multiple mortises (14*a*) and the sidewall of the second casing is formed with multiple tenons corresponding to the mortises (14*a*), whereby the tenons are inserted in the mortises (14*a*) to assemble the first and second casings with each other, the other face of the second casing opposite to the sidewall being formed with mortises (24*a*), the subsidiary sidewall being formed with multiple tenons corresponding to the mortises (24*a*) of the second casing, the tenons being inserted into the mortises (24*a*) to assemble the subsidiary sidewall with the second casing.

29. The connection member as claimed in claim 25, wherein the first casing is formed with a dent and the subsidiary sidewall is also formed with a dent, an operation lever having stubs corresponding to the dents, the stubs of the operation lever being respectively inserted into the dent of the first casing and the dent of the subsidiary sidewall, whereby the operation lever can be reciprocally moved about the stubs and the dents between a first dead end and a second dead end.

30. The connection member as claimed in claim 27, wherein the first and second casings and the subsidiary sidewall are formed with dents, an operation lever having stubs corresponding to the dents, the stubs of the operation lever being respectively inserted into the dents, whereby the operation lever can be reciprocally moved about the stubs and the dents between a first dead end and a second dead end.

* * * * *